US006279823B1

(12) United States Patent
Chou

(10) Patent No.: US 6,279,823 B1
(45) Date of Patent: Aug. 28, 2001

(54) TELEPHONE PAYSTATION COIN RECEPTACLE COVER

(75) Inventor: Simon W. Chou, Marietta, GA (US)

(73) Assignee: OTC Telecom Corporation, Marietta, GA (US)

( * ) Notice: Subject to any disclaimer, the term of this patent is extended or adjusted under 35 U.S.C. 154(b) by 0 days.

(21) Appl. No.: 09/348,372

(22) Filed: Jul. 7, 1999

(51) Int. Cl.[7] ..... G07B 15/00

(52) U.S. Cl. ..... 232/15; 232/16; 379/145; 379/437; 379/451

(58) Field of Search ..... 232/15, 16, 31, 232/32, 1 D, 12, 55; 379/143, 145, 445, 451, 437; 194/202, 350

(56) References Cited

U.S. PATENT DOCUMENTS

| | | | |
|---|---|---|---|
| 3,837,566 | | 9/1974 | McGough . |
| 3,926,366 | * | 12/1975 | Sciortino . |
| 4,124,774 | | 11/1978 | Zarouni . |
| 4,124,775 | | 11/1978 | Zarouni . |
| 4,194,775 | | 3/1980 | Shea . |
| 4,204,709 | | 5/1980 | Shea . |
| 4,456,165 | | 6/1984 | Sciortino ..... 232/15 |
| 4,529,119 | * | 7/1985 | Granzow et al. . |
| 4,659,008 | * | 4/1987 | Howett et al. . |
| 4,798,316 | * | 1/1989 | Martin et al. . |
| 4,890,766 | * | 1/1990 | Martin et al. . |
| 5,012,075 | * | 4/1991 | Hutchinson et al. . |
| 5,038,908 | | 8/1991 | McGough . |
| 5,515,030 | | 5/1996 | Citron et al. . |
| 5,802,172 | | 9/1998 | Ingalsbe et al. . |
| 6,047,065 | * | 4/2000 | McGough . |

* cited by examiner

*Primary Examiner*—B. Dayoan
*Assistant Examiner*—William L. Miller
(74) *Attorney, Agent, or Firm*—Morris, Manning & Martin, LLP

(57) ABSTRACT

A shutter plate for a self-locking cover for a telephone paystation coin receptacle includes a coupler for joining a shutter control arm to the shutter plate that deforms when a force having a predetermined magnitude is applied to the control arm. The deformation of the coupler provides an indicator that an attempt to move the shutter plate to expose an aperture in the self-locking cover has occurred. The coupler may be one or more holes in a portion of the shutter control arm that is external of the self-locking cover. The coupler may take the form of a weld that joins the shutter control arm and the shutter plate. Frangible material may also be used to fill openings in the control arm to provide a tamper indicator. The tamper indicator facilitates detection of tamper attempts by visual inspection.

22 Claims, 2 Drawing Sheets

TELEPHONE PAYSTATION COIN RECEPTACLE COVER

FIELD OF THE INVENTION

The invention relates generally to coin operated telephone paystations, and more particularly, to self-locking covers for coin receptacles which collect money inserted into telephone paystations.

BACKGROUND OF THE INVENTION

Self-locking coin receptacles are used with telephone paystations to facilitate coin collection. Most self-locking coin receptacles of the major telephone paystation manufacturers (e.g., AT&T, Nortel, Lucent, BellSouth, Pacific Bell, U.S. West, Ameritech, Bell Atlantic and GTE) are similar. The basic operation of self-locking coin receptacles is described in detail in U.S. Pat. No. 3,837,566 to McGough, incorporated herein by reference.

A self-locking coin receptacle includes a receptacle and a self-locking aperture cover. The self-locking aperture cover has mounted within it a shutter plate and a shutter control arm that extends externally of the cover to engage a bracket in the vault within the paystation. Sliding the receptacle into the vault of a paystation moves the control arm which opens a shutter covering an aperture within the cover. Coins traveling down a coin track pass through the open aperture to the receptacle. When the receptacle is removed from the paystation, a biasing member moves the shutter plate so it closes the aperture to the receptacle. The cover includes a latching mechanism that blocks movement of the shutter plate so the aperture remains closed and easy access to the contents of the receptacle is thereby denied.

Self-locking receptacles were developed so the receptacle could be removed from a paystation and transported to a safe collection facility rather than having the employee empty the receptacle at the paystation. Accumulation of money from receptacles at multiple paystations results in sums of money that may entice robbery attempts and present risks to the service personnel. The incentive for robbery declines if a thief has to defeat a locking mechanism to access the contents of each receptacle a service person may possess. Also, the self-locking covers help deter employees from taking a portion of the money contained within the receptacles of paystations on a service route.

Attempts have been made to design self-locking coin receptacles that are substantially tamper proof or that indicate whether tampering or tampering efforts have occurred. For example, U.S. Pat. Nos. 4,194,775 to Shea, 5,515,030 to Citron, et al. and 4,204,709 to Shea disclose systems that improve the locking engagement between a self-locking cover and its coin receptacle. However, telephone paystation companies have discovered that some self-locking covers can be forced open and the contents of the receptacle accessed without leaving readily noticeable signs of tampering. Thus, service personnel may be able to remove some or all of the contents of a coin receptacle without providing any indication of receptacle tampering.

SUMMARY OF THE INVENTION

The limitations of known self-locking covers for coin receptacles are overcome by a self-locking receptacle made in accordance with the principles of the present invention. The present invention provides a system that indicates that an attempt to forcibly open the cover aperture has occurred. The system includes a shutter for selectively blocking an aperture to a self-locking coin receptacle, a shutter control arm coupled to the shutter, and a tamper indicator operatively coupled to the shutter control arm, the tamper indicator responding to a force of a predetermined magnitude to indicate an attempt was made to move the shutter control arm to expose the aperture in the self-locking coin receptacle while the shutter was in a locked position. The tamper indicator facilitates visual inspection of the exterior of a self-locking receptacle to detect a tamper attempt.

The predetermined magnitude of the force to which the tamper indicator responds is selected to be less than the force necessary to defeat the latching mechanism that resists movement of the shutter to expose the coin aperture. The tamper indicator may be a coupler that joins the shutter control arm to the shutter. The coupler may be made of a zinc-aluminum alloy. Alternatively, the coupler may be a weld of material that joins the shutter control arm and shutter and that deforms in response to a force a little less than the predetermined magnitude. In another to embodiment the coupler includes at least one opening defined in the shutter control arm that causes the coupling to deform in response to a force a little less than the predetermined magnitude. The opening may be filled with a frangible material that shatters when a force at the predetermined threshold is applied to the control arm. For example, the material may be a ceramic material or a polymer material.

Another embodiment of the invention provides a self-locking coin receptacle cover for use with a coin receptacle. The cover includes a cover base having an aperture, a shutter plate rotatably mounted to the base, the shutter plate having a shutter control arm, a portion of which is external of the cover base to move a portion of the shutter plate so it selectively blocks the aperture, a latching mechanism for blocking movement of the shutter plate, and a tamper indicator operatively coupled to the shutter control arm, the tamper indicator responding to a force applied to the shutter control arm to indicate an attempt was made to move the shutter control arm to uncover the aperture when the shutter was in a locked position.

The shutter control arm is preferably deformed when a force is applied to the shutter control arm in a direction that opens the aperture and the force approaches the force necessary to cause the shutter plate and a prong in the latching mechanism to slip by one another.

Accordingly, an object of the present invention is to provide a self-locking coin receptacle cover that cannot be forced open without leaving irreversible signs of tampering. One advantage of the present invention is that it works with the current installed base of paystations and another is that it is cost-efficient to manufacture.

DETAILED DESCRIPTION OF THE INVENTION

Figure 1:
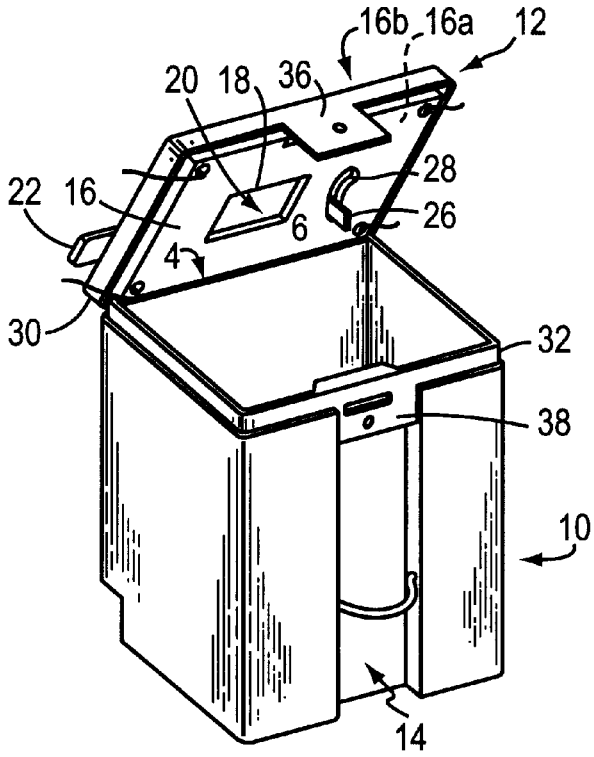
FIG. 1 (PRIOR ART)
FIG. 1 is a perspective view of a known self-locking cover and coin receptacle.

A description of the preferred embodiment of the present invention is provided in connection with the accompanying figures. Like reference numerals are used in the figures to identify the same structural elements, portions or surfaces throughout the several drawings figures, as such elements, portions or surfaces may be further described or explained by the entire written specification, of which this detailed description is an integral part. The drawings are intended to be read together with the specification, and are to be considered a portion of the entire written description of this invention.

FIG. 1 shows a self-locking coin receptacle 10 comprising a cover 12 and a coin receptacle 14. Cover 12 includes a base 16 having an aperture 18 defined therein and a shutter 20. Shutter 20 is a portion of shutter plate 42 (FIG. 3). Shutter plate 42 is rotatably mounted about a pin so shutter plate 42 moves in a plane between inner wall 16*a* and outer wall 16*b* of base 16. Shutter plate 42 also includes a control arm 22 that extends through slot 24 and bends at approximately a 90° angle so it is approximately parallel to outer wall 16*b* extends beyond edge 30 of cover 12. Movement of control arm 22 in arcurate slot 24 moves shutter 20 to open or close aperture 18. Cover 12 is coupled to receptacle 14 by hinge elements, such as offset hinge arms extending from outer wall 16*b* of cover 12 that are received within slots formed or cut within lip 32 of receptacle 14. Such hinges are merely exemplary and are not shown in the figures as they are well known. Other hinge constructions may be used. A closure member 36 extends from cover 12 and its outboard end may include an extension that is functionally snapped into receiving indentation 38 or the outbound end may include a slot that receives a locking tab mounted on receptacle 14. Again, such structure in coin receptacles is known in telephone paystations. Mounted between inner wall 16*a* and outer wall 16*b* is a latching mechanism 34 (FIG. 3) that includes a reset arm 26 that extends through elongated opening 28. Latching mechanism 34 engages shutter plate 42 to control its freedom of movement about its mounting pin. Moving reset arm 26 to its first position (FIG. 2) causes shutter 20 to be biased into a position that blocks aperture 18.

Figure 2:
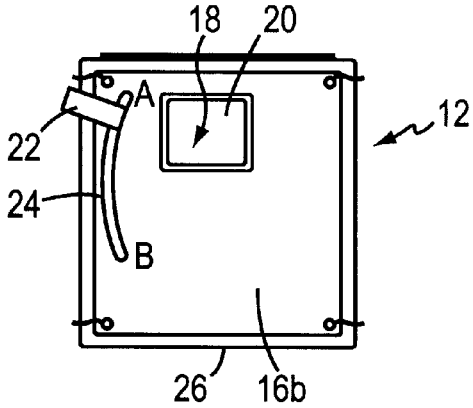
FIG. 2 (PRIOR ART)
FIG. 2 is a plan view of the outer wall of the coin receptacle cover of FIG. 1.
Figure 3:
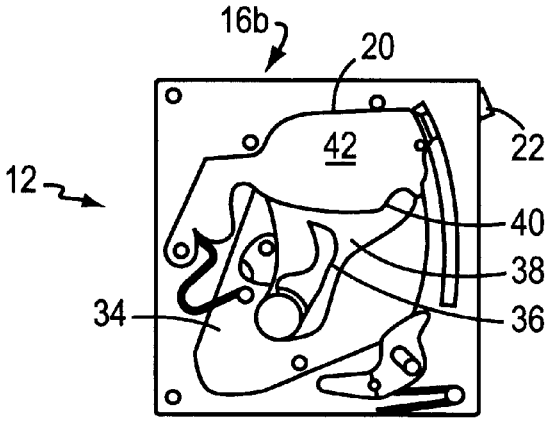
FIG. 3 (PRIOR ART)
FIG. 3 is a plan view of the underside of the outer wall shown in FIG. 2.

FIG. 2 shows outer wall 16*b* of cover 12. In the figure, aperture 18 is closed by shutter 20 and shutter control arm 22 extends beyond the periphery of cover 12. At position A, coin receptacle 14 is locked and ready for insertion in the vault of a telephone paystation. As receptacle 14 is slid along the rails of the bracket within the vault of a paystation, control arm 22 is engaged by the bracket so it moves along slot 24 to position B and thereby rotates shutter 22 to open aperture 18. Latching mechanism 34 is also engaged by shutter plate 42 so control arm 22 is biased to rotate shutter 20 and close aperture 18 as receptacle 14 is removed from the vault of a paystation. Upon return to position A, latching mechanism 34 blocks movement of control arm 22 within slot 24 so aperture 18 remains closed by shutter 20.

Self-locking coin receptacle 10 is prepared for deployment at a paystation by moving reset arm 26 to unlock shutter 20 so it returns to its biased position which closes aperture 18. Cover 12 is pivoted about its hinge to close coin receptacle 14 and closure member 36 is secured to receptacle 14 as is well known in the art. A service person then takes a group of locked coin receptacles 10 to swap with those deployed at paystations. After removal of a coin receptacle from a paystation, coin receptacle 10 is inserted into the vault of a paystation by sliding the receptacle between the rails of a bracket (not shown) within the vault. When the self-locking coin receptacle 10 is inserted into the vault, shutter control arm 22 engages the edge of a slot in the bracket which causes the unlocked shutter 20 to open as the shutter control arm 22 moves along arcurate track opening 28. Insertion of coin receptacle 10 and the movement of shutter plate 42 triggers latching mechanism 34 to cooperate with shutter plate 42 and control shutter 20.

FIG. 3 shows the underside of outer wall 16*b* of cover 12. Shutter plate 42 is shown in the position where shutter 20 closes aperture 18. Prong 36 of latching mechanism 34 and shutter plate 22 rest above plate 38. Prong 36 abuts and blocks shutter plate 42 as control arm 22 moves from position A in slot 24. This action of prong 36 prevents aperture 18 from being uncovered by shutter 20. Prong 36 and shutter plate 42 are moved to the locked position shown in FIG. 3 when a self-locking coin receptacle is removed from a telephone paystation vault.

In previously known shutter locking devices, sufficient force applied to shutter control arm 22 can cause shutter plate 42 and prong 36 to deflect in opposite directions when prong 36 is locked by latching mechanism 34 so shutter plate 42 can move over or under prong 36. This movement permits shutter 20 to uncover aperture 18 and provide access to coin receptacle 14. After coins are removed from the coin receptacle, force may then be applied to control arm 22 to substantially reverse the deflection of the shutter 20 and prong 36 and return shutter 20 to its closed position. Cover 12 then appears to be in its original locked position and evidence of tampering is not readily apparent. A person who performed the theft can turn in the self-locking coin receptacle with little fear of detection. Even if the tampering is noticed after a thorough inspection, the inspector cannot ascertain whether the tampering occurred on the current service run or a prior service run.

The present invention deters theft by making readily identifiable an attempt at tampering with shutter control arm 22 once latching mechanism 34 is engaged. The present invention helps make tampering readily apparent by providing a connection or coupling between shutter control arm 22 and shutter 20 that breaks or decouples or that deforms in response to a force being applied to shutter 22 when prong 36 is locked by latching mechanism 34. That is, the force necessary to break the coupling or connection or to deform the shutter control arm is less than the force required to deflect prong and shutter so they pass over one another. The decoupling, breaking or deformation may be more easily detected than evidence of tampering occurring on previously known coin receptacles.

FIGS. 4–7 show various embodiments of a shutter plate that are constructed according to the principles of the present invention. Shutter plate 50 of FIG. 4 includes a body 52 and a shutter control arm 54 having an opening 56 defined therein that weakens shutter control arm 54. This weakened portion causes shutter control arm 54 and opening 56 to deform or causes one or both of the arms surrounding opening 56 to break in response to a force being applied to shutter control arm 54 that would deflect shutter plate 50 to pass prong 36. Such deformation or breakage readily identifies coin receptacle tampering without requiring cover 12 to be removed from coin receptacle 14.

Shutter control arm 54 should be strong enough to engage and work with the bracket of the paystation vault as intended without deformation or failure in normal operation. Thus, any deformation or failure of shutter control arm 54 cannot be blamed on normal wear and tear. The shutter plate and shutter control arm of the present invention may be used in previously known designs for self-locking coin receptacles by simply replacing the previously known shutter plates with the shutter plate of the present invention. Accordingly, the invention is compatible with the majority of the installed base of telephone paystations and can be produced at a cost similar to previously known self-locking coin receptacles.

Figure 5:
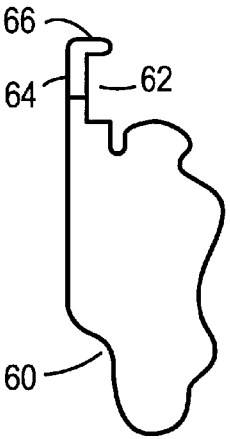
FIG. 5 is a plan view of an embodiment of a shutter plate configured with a control arm having an L-shaped flange at its outboard end.
Figure 4:
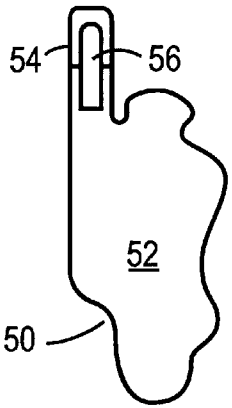
FIG. 4 is a plan view of an embodiment of a shutter configured with an opening in the shutter control arm to weaken the arm.

Shutter plate 60 of FIG. 5 is another embodiment of a shutter constructed in accordance with the principles of the present invention. Shutter plate 60 includes a generally L-shaped flange 66 that terminates shutter control arm 62 and weakens the structural integrity of the control arm 62. The L-shaped shutter control arm 62 may have an opening defined therein to further weaken the arm as discussed above. The length and width of L-shaped flange 66 closely corresponds to the length and width of control arm 22 that extends from slot 24. This is preferably done to render shutter plate 60 compatible with known coin receptacles although the dimensions of shutter arm 62 may be adopted for other designs without departing from the principles of the present invention.

Figure 6:
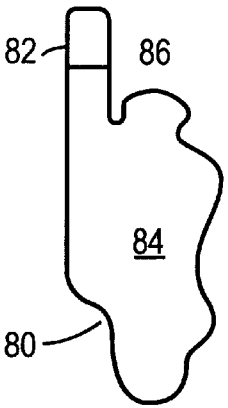
FIG. 6 is a plan view of an embodiment of a shutter plate made from zinc-aluminum alloy.

FIG. 6 shows shutter plate 80 which has the same general shape as shutter plate 42 discussed above. Whereas shutter 20 is traditionally made of a steel alloy, shutter 80 is made of a material more malleable or brittle than steel alloys. Specifically, shutter plate 80 and/or shutter control arm 82 is preferably made of a zinc-aluminum alloy. The thickness of connecting arm 86 that couples shutter control arm 82 to shutter plate body 84 is selected so that a force applied to shutter control arm 82 that forces the shutter plate past the prong in known covers causes shutter control arm 82 to permanently deform or break from body 84.

Figure 7:
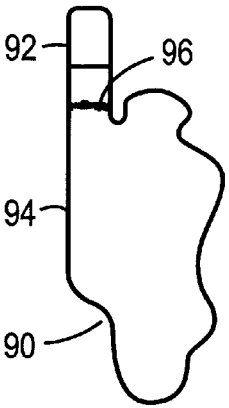
FIG. 7 is a plan view of an embodiment of a shutter plate having a control arm joined to the plate by a weld.

Referring to FIG. 7, shutter plate 90 is generally the same shape as shutter plate 42 but instead is constructed in two pieces rather than an integral structure. Shutter control arm 92 and body 94 are welded together at welding junction 96. Weld 96 fails (e.g., deforms by breaking or bending) upon the application of a force to shutter control arm 92 that is less than the force required to pass shutter 90 by a latching mechanism prong 36 when shutter plate 90 and the prong are in the locked position. While a weld is the preferred coupling structure of this embodiment other joining materials, such as adhesives or other chemical bonds, may be used in like manner.

Figure 8:
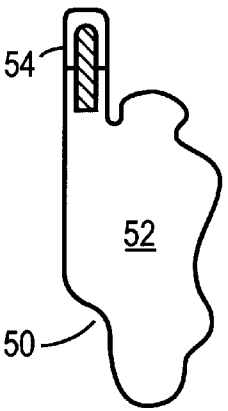
FIG. 8 shows the shutter plate of FIG. 3 with the opening being filled with a frangible material.

Referring to FIG. 8, another embodiment of the present invention is illustrated. The embodiment illustrated in FIG. 8 has the same basic shutter design and shutter control arm design as the embodiment discussed in connection with FIG. 3; however, opening 56 provides an additional indication that an attempt has been made to open the shutter of a self-locking coin receptacle when the shutter is in its closed or locked position. Preferably, opening 56 is filled with a frangible material that shatters, breaks, or otherwise is permanently altered in response to an attempt to defeat the locking mechanism of a self-locking cover for a coin receptacle box. The material should be made of material that is difficult to replace without an indication of tampering. Such materials may include polymers, ceramic, or other materials such as glass, acrylics, plastic, cement, clay or the like. The material used to fill opening 56 should be sufficiently thick or durable to withstand normal movement of the coin receptacle box without shattering, deforming, or otherwise indicating that a tamper event has occurred.

Although preferred embodiments of the invention have been disclosed and described, those skilled in the art will recognize modifications can be made without departing from the scope of the invention. It should be appreciated that the various characteristics the embodiments discussed herein can be combined in accord with the present invention. For example, the shutter control arm can be made of a zinc-aluminum alloy with body made of a steel alloy. As a further alternative, the shutter control arm and body of a shutter may be made of the same material, but of different thicknesses.

What is claimed is:

1. A system included within a self-locking coin receptacle for indicating that a person has tampered with the self-locking coin receptacle, comprising:

a shutter for selectively blocking an aperture to the self-locking coin receptacle;

a shutter control arm coupled to said shutter, said shutter control arm for moving said shutter; and a tamper indicator operatively coupled to said shutter control arm, said tamper indicator responding to a force applied to said shutter control arm by deforming, breaking, or bending to indicate an attempt was made to move the shutter control arm to expose the aperture in the self-locking coin receptacle while the shutter was in a locked position.

2. A self-locking coin receptacle cover for use with a coin receptacle, said cover comprising:

a cover base having an aperture therethrough;

a shutter plate rotatably mounted within said base, said shutter plate having a shutter control arm, a portion of which extends externally of said cover base so that said shutter plate may be moved so a portion thereof selectively blocks said aperture;

a latching mechanism mounted within said cover base for engaging said shutter plate and blocking movement of said shutter plate to open said aperture; and a tamper indicator operatively coupled to said shutter control arm, said tamper indicator responding to a force applied to said shutter control arm by deforming, breaking or bending to indicate an attempt was made to move said shutter control arm to expose said aperture in the self-locking coin receptacle cover when said shutter plate was locked by said latching mechanism.

3. A system included within a self-locking coin receptacle for indicating that a person has tampered with the self-locking coin receptacle, comprising:

a shutter for selectively blocking an aperture to the self-locking coinreceptacle;

a shutter control arm coupled to said shutter, said shutter control arm for moving said shutter;

a tamper indicator operatively coupled to said shutter control arm, said tamper indicator responding to a force applied to said shutter control arm to indicate an attempt was made to move the shutter control arm to expose the aperture in the self-locking coin receptacle while the shutter was in a locked position; and said tamper indicator being a coupler for joining said shutter control arm to said shutter and said coupler deforms in response to a force exceeding a predetermined magnitude being applied to said shutter control arm.

4. The system of claim 3 wherein said coupler is made of a zinc-aluminum alloy.

5. The system of claim 3 wherein said shutter control arm is coupled to said shutter by a weld.

6. The system of claim 5 wherein said weld is an adhesive.

7. The system of claim 3 wherein said coupler includes at least one opening in a portion of said shutter control arm that causes said shutter control arm to deform in response to said force.

8. The system of claim 7 wherein said opening is filled with a frangible material.

9. The system of claim 8 wherein said frangible material is ceramic.

10. The system of claim 6 wherein said frangible material is polymeric.

11. The system of claim 3 wherein said coupler bends in response to said force.

12. The system of claim 3 wherein said coupler breaks in response to said force.

13. A self-locking coin receptacle cover for use with a coin receptacle, said cover comprising:

a cover base having an aperture therethrough;

a shutter plate rotatably mounted within said base, said shutter plate having a shutter control arm, a portion of which extends externally of said cover base so that said shutter plate may be moved so a portion thereof selectively blocks said aperture;

a latching mechanism mounted within said cover base for engaging said shutter plate and blocking movement of said shutter plate to open said aperture;

a tamper indicator operatively coupled to said shutter control arm, said tamper indicator responding to a force applied to said shutter control arm to indicate an attempt was made to move said shutter control arm to expose said aperture in the self-locking coin receptacle cover when said shutter plate was locked by said latching mechanism; and said tamper indicator being a coupler for joining said shutter control arm to said shutter and said coupler deforms in response to a force exceeding a predetermined magnitude being applied to said shutter control arm.

14. The system of claim 13 wherein said coupler is made of a zinc-aluminum alloy.

15. The system of claim 13 wherein said control arm is coupled to said shutter by a weld.

16. The system of claim 15 wherein said weld is an adhesive.

17. The system of claim 13 wherein said coupler includes at least one opening in a portion of said shutter control arm that causes said shutter control arm to deform in response to said force.

18. The system of claim 17 wherein said opening is filled with a frangible material.

19. The system of claim 18 wherein said frangible material is ceramic.

20. The system of claim 18 wherein said frangible material is polymeric.

21. The system of claim 13 wherein said coupler bends in response to said force.

22. The system of claim 13 wherein said coupler breaks in response to said force.

* * * * *